US005165121A

United States Patent [19]

McTargett et al.

[11] Patent Number: 5,165,121

[45] Date of Patent: Nov. 24, 1992

[54] FABRICATED FAUCET SPOUT

[75] Inventors: Charles W. McTargett; Mark A. Bendit, both of Indianapolis; Garry R. Marty, Fishers, all of Ind.

[73] Assignee: Masco Corporation of Indiana, Taylor, Mich.

[21] Appl. No.: 642,627

[22] Filed: Jan. 17, 1991

[51] Int. Cl.[5] ..... E03C 1/04

[52] U.S. Cl. ..... 4/678; 137/801

[58] Field of Search ..... 4/191, 192; 137/801

[56] References Cited

U.S. PATENT DOCUMENTS

| | | | |
|---|---|---|---|
| 2,781,786 | 2/1957 | Young | 137/375 X |
| 3,025,085 | 3/1962 | Young | 4/192 X |
| 3,590,876 | 7/1971 | Young | 137/801 |
| 3,871,406 | 3/1975 | Anderson | 4/191 X |
| 4,649,958 | 3/1987 | Purcell | 4/191 X |

*Primary Examiner*—Charles E. Phillips
*Attorney, Agent, or Firm*—Dykema Gossett

[57] ABSTRACT

An improved fabricated faucet is disclosed in which no mounting screws are visible when the spout is mounted. In a preferred embodiment an under cover has a notch received on a tab within an internal surface of an upper cover to secure the two at a forward end. Screws preferably secure the two at a rearward end, which will be hidden when the spout is mounted. For longer spouts it may be preferable to use two of the notch and tab combinations spaced symmetrically about a central axis of the spout. Ribs formed on the upper cover may abut the under cover to provide additional rigidity. In another aspect of the present invention, an outlet end portion of a fluid flow line is received in an outlet port formed through the under cover. The outlet end portion has threads at an inner periphery to mount an end effector, such as an aerator or a stream straightener. A sealing ring is received at the outer periphery of the outlet end portion to provide a fluid seal between the outlet end and the under cover body. This allows the faucet spout to be utilized without internal leakage even if the end effector is removed.

8 Claims, 6 Drawing Sheets

FABRICATED FAUCET SPOUT

BACKGROUND OF THE INVENTION

This application relates to an improved fabricated faucet spout. More particularly, the present invention relates to a fabricated faucet spout that overcomes several limitations in the prior art with regard to both finished appearance and leakage.

Faucet spouts can be divided into two types. Cast faucet spouts are formed of a monolithic body of material cast to include internal flow passages. This type of spout is used in some applications, however, there are limitations on a cast spout. As an example, the casting methods required to form such spouts are complicated and expensive.

As an alternative to cast spouts, fabricated spouts are known in the prior art. A fabricated spout includes a plurality of individual members which are assembled to complete the final faucet spout. Typically, a housing having upper and under cover members are secured together to enclose a fluid flow line. The faucet spout extends longitudinally from an inlet forwardly to the outlet of the fluid flow line. The upper and under cover members must be secured together at forward and rearward positions in order to provide adequate stability to the assembled housing.

Prior art fabricated faucet spouts have used screws, or other attachment members, which extend through the under cover and into bosses in the upper cover to secure the two housing parts together. Typically, several screws extend through screw holes formed at a rearward portion of the under cover and into bosses in the upper cover. Forward screws extend through screw holes formed at longitudinally spaced locations along the body of the under cover in a direction towards the outlet, and into mating bosses in the upper cover.

Such constructions have several limitations. The screws near the rear portion of the faucet spout are generally hidden from view once the spout is mounted to the sink top, but the screws spaced longitudinally forwardly on the spout are visible when the spout is mounted. This creates undesirable disruptions in the visual appearance of the spout. Further, the screws typically may be coated to approximate the finish or color of the remainder of the spout housing so that they will be less visible. The screws are preferably off-the-shelf items which must be sent to a treating process to receive such a finish on their heads. This is time consuming and expensive.

Further, the bosses formed on the inner surface of the upper cover to receive screws result in irregularities in the outer surface of the upper cover. The formation of a boss on an inner surface of the upper cover typically creates sink marks, or irregularities in the outer surface of the upper cover, which are undesirable. Also, the concentration of molten metal in the mold aperture which forms the boss sometimes results in damage to the mold. For these reasons it would be desirable to reduce the number of bosses required in the upper cover.

Other problems with the prior art fabricated spouts involve leakage relating to the connection of end effectors to the outlet of the spout. Typically, an end effector such as an aerator, a spray straightener, a nozzle, or any other outlet member, is screwed to a threaded connection within an outlet end portion of the spout. The threaded connection in the outlet end portion typically has a lowermost end generally aligned with, or slightly above, an outlet port in the under cover. It is undesirable to have the outlet end portion of the fluid flow line extend outwardly of the outlet port in the undercover, since the flow line is often of a different finish than the remainder of the faucet housing and is preferably not visible from outside the spout housing. As such, the end effector usually extends upwardly into the faucet housing, and into the outlet end portion where it is secured. This causes leakage problems should the end effector be removed, since the bottom of the outlet end portion is positioned and aligned with, or above, the outlet port in the under cover. Water may leak between the outlet end portion and the under cover into the housing.

Faucets are often operated without end effectors. As an example, when faucets are initially mounted it is recommended that any end effector be removed, and water ran through the faucet to clean the flow line. This is particularly important in home construction, where particles and debris may clog the line prior to its being mounted. End effectors typically have small ports which could become clogged with materials that are being cleaned out of the flow line by this initial flow. Also, end effectors in public restrooms are often stolen. In either situation the faucet must operate without an end effector.

It is an object of the present invention to disclose an improved fabricated faucet spout in which the upper and under cover members are secured together without any visible screws or other securing members. Further, it is the object of the present invention to disclose an improved fabricated spout in which a seal is provided between the outlet end portion of the flow line and the under cover body such that the faucet may operate properly without an end effector.

SUMMARY OF THE INVENTION

In a disclosed embodiment of the present invention, an under cover is secured to an upper cover through known securing members at a rearward position, adjacent a fluid line inlet, where they are hidden when the spout is mounted. The forward portions of the upper and under covers are connected through a notch and tab arrangement. The notch is preferably formed in a lip in the under cover that extends within a bottom wall of the upper cover. In this way, no securing members are visible when the spout is mounted. A disclosed relatively long spout has a pair of notches and tabs spaced laterally about a central longitudinal axis.

Preferably, the notch is formed as an aperture through a flange extending upwardly from the main body of the lip with a portion of the flange extending above the aperture. This portion extends into a channel formed between the tab and a stop member, with the tab received in the aperture to provide a secure connection between the upper and under covers.

Preferably, ribs extend from the upper cover downwardly and abut the lip on the under cover to provide additional rigidity. The number of ribs would increase with increased spout length.

In another aspect of the present invention the fluid line has an outlet end portion received in an outlet port formed through the under cover. The outlet end portion preferably has means at an inner periphery to mount an end effector, such as an aerator, stream straightener, nozzle, or other end connection. The outer periphery of the outlet end portion preferably has a first smaller diameter portion and a second larger diameter portion spaced upstream from the first portion. A resilient ring is preferably mounted on the first portion and compressed between the second portion and an internal face of the under cover. The ring provides a resilient seal between the bottom of the outlet end portion and the under cover. In this way, the faucet spout can be utilized without any leakage between the outlet end portion and the interior of the housing of the spout should the end effector be removed.

In a most preferred embodiment of the present invention the ring is preferably square in cross-section and extends for a distance longer than the first portion such that it is compressed when the upper and under covers are secured together.

These and other aspects and features of the present invention can be best understood from the following specification and drawings, of which the following is a brief description.

DETAILED DESCRIPTION OF A PREFERRED EMBODIMENT

Figure 1:
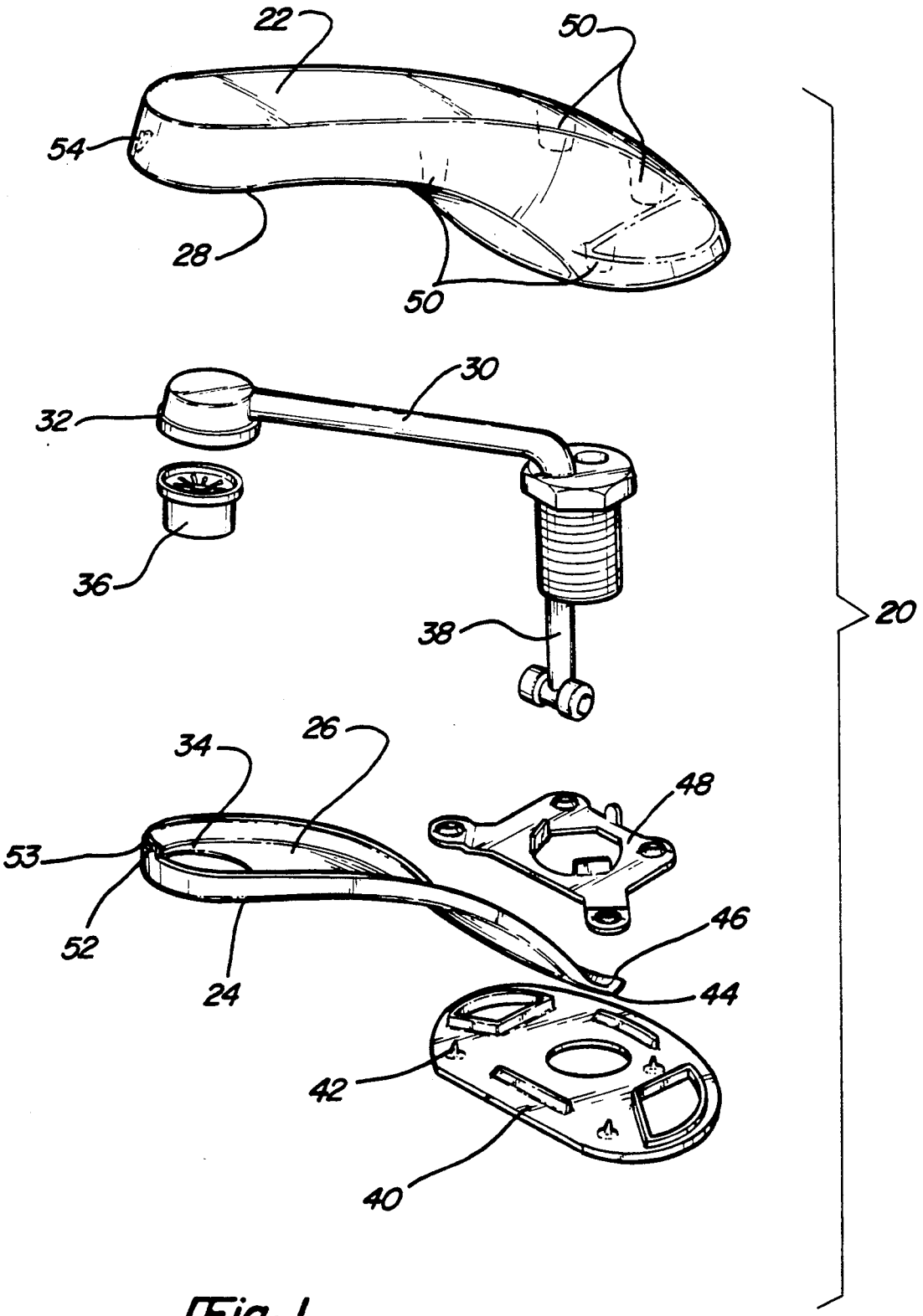
FIG. 1 is an exploded view of a first embodiment of the invention.

FIG. 1 is an exploded view of a first embodiment fabricated spout 20 which has upper housing, or upper cover 22, secured to under cover 24. Escutcheon 24 has lip 26 extending in a direction toward upper cover 22, which fits within lower wall 28 of upper cover 22. Fluid line 30 is secured between under cover 24 and upper cover 22 and communicates fluid to an outlet port at a bottom end of outlet end portion 32. Outlet end portion 32 is received in outlet 34 formed through under cover 24. End effector 36 is attached to a bottom face of outlet port 32, and may be any end member such as an aerator or a stream straightener, as are well known in the prior art. T-connection 38 is attached at an inlet end of fluid line 30 and receives mixed fluid from a source of both hot and cold water.

Mounting plate 48 secures spout 20 in a mounted position as is well known in the art, and a plurality of screws 42 extend through screw holes 44 formed in rear bases 46 of under cover 24. Screws 42 extend through holes 44, through mounting plate 48 and are received in bosses 50 formed in an inner surface of upper cover 22. All four bosses 50 receive screws 42, which will be hidden from view once spout 20 is mounted to a sink top or the like. Although screws are disclosed, other securing members, such as plugs are within the scope of this invention. Further, only the forward two screws pass through under cover 24. The rearward two screws pass through plate 48 and into bosses 50. Gasket 40 provides a seal.

Under cover 24 is secured to upper cover 22 at a forward end by the combination of notch 52 formed in flange 53 extending from a body of lip 26, which is received on tab 54 formed within a forward interior surface of upper cover 22.

Figure 2:
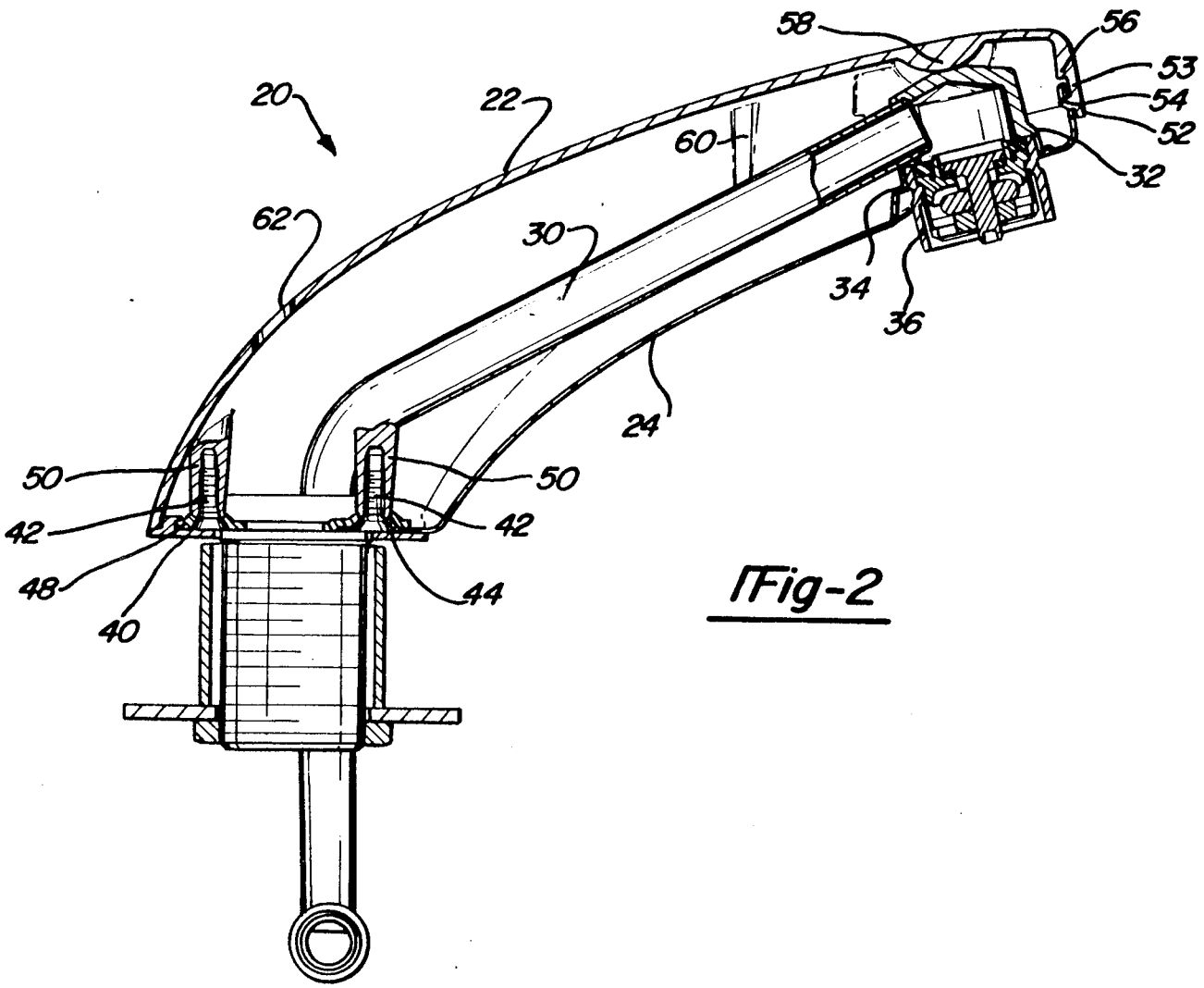
FIG. 2 is a cross-sectional view through the first embodiment illustrated in FIG. 1.

FIG. 2 shows the assembled fabricated faucet spout 20. Screws 42 extend through holes 44 and into bosses 50. As shown, all screws 42 are hidden from view in this mounted position. Tab 54 has a stop 56 and flange 53 having notch 52 is received on tab 54 with the portion of flange 53 above notch 52 received in a channel formed between rib 54 and stop 56. The channel is formed by a fly cut-out member, which is a type of rotary cutter. Preferably, a combined rib including members 54 and 56 is initially molded and the central channel is then cut between the two. Tab 54 received in notch 52 provides sufficient stability to secure under cover 24 to upper cover 22 at a forward end. Screws 42 secure the two at a rearward end. Thus, no visible securing members are utilized to secure under cover 24 to upper cover 22.

Rib 60 extends from upper cover 22 downwardly, and rests on lip 26 of under cover 24 to add additional stability. Opening 62 may receive a lift rod actuator handle.

Figure 3:
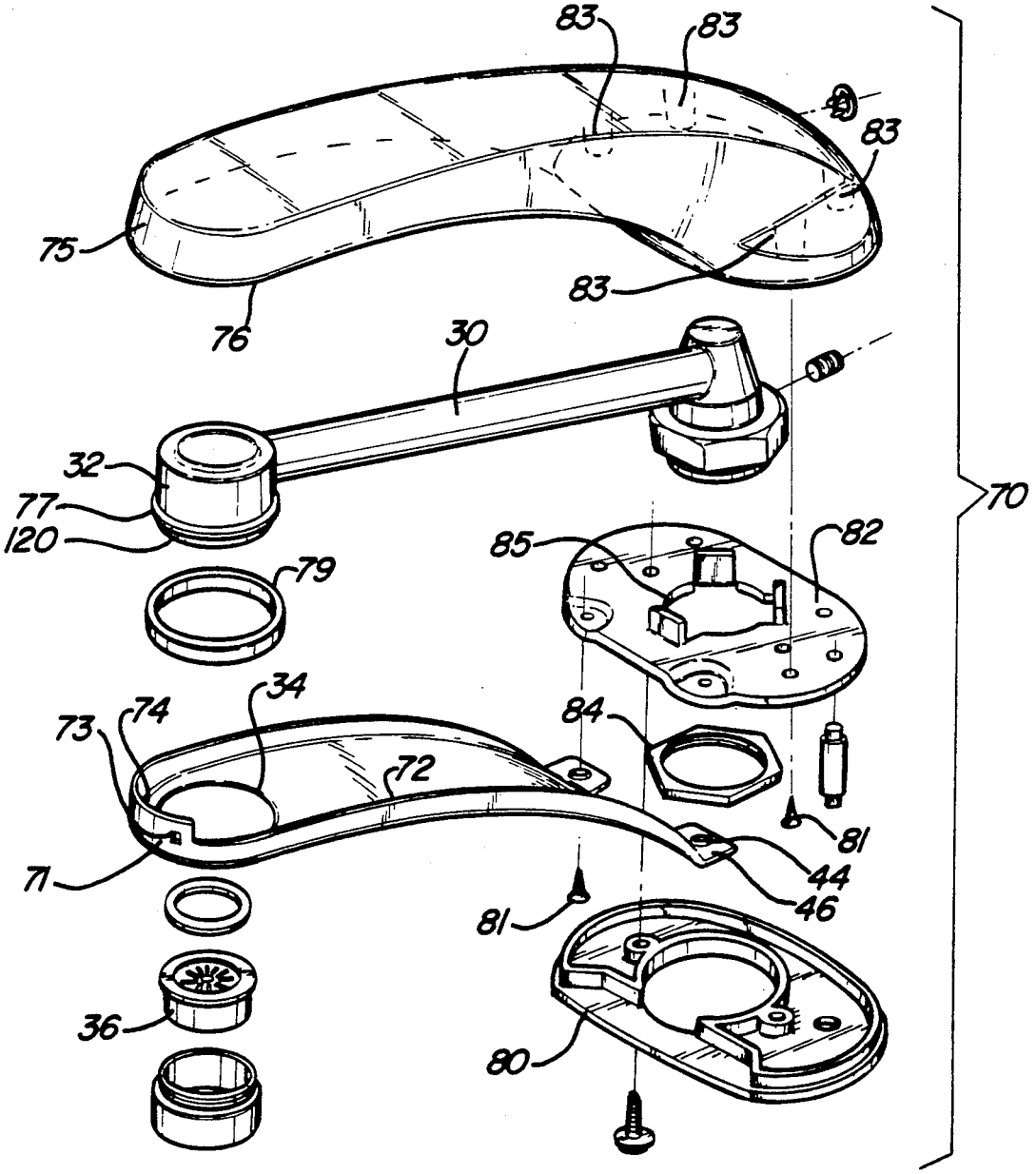
FIG. 3 is an exploded view of a second embodiment of the present invention.

FIG. 3 shows a second fabricated spout 70 including under cover 71 having lip 72 and notch 73 spaced near a lateral end of flange 74. Flange 74 preferably has a mating notch 73 at an opposed lateral side, facing into the paper in this figure. Under cover 71 is mounted to upper cover 75 having lower wall 76 which receives lip 72. Flow line 30 is mounted between under cover 71 and upper cover 75 and has outlet end portion 32 received in outlet 34 formed in under cover 71. Outlet end portion 32 has a first portion 120 of a smaller diameter and a second portion 77 of a diameter greater than the first portion and forming a stop for sealing ring 79 received on first portion 120. Outlet end portion 32 is preferably received in outlet 34 such that the bottom end of first portion 120 is roughly aligned with outlet 34 in under cover 71. End effector 36 is then attached to internal threads in outlet end portion 32. Sealing ring 79 is received between second portion 77 and the internal surface of under cover 71 to seal a contact surface between under cover 71 and outlet end portion 32. Preferably, ring 79 is square in cross-section and of a length greater than the length of first portion 120 such that it is compressed to create a good seal.

Mounting plate 82 mounts faucet 70 as is known. Screws 81 extend through screw holes 44 formed in bases 46 on under cover 71, and through mounting plate 82. Other screws 81 extend through plate 82 and into bosses 83 in upper cover 75. Fluid line 30 is preferably received within mounting plate 82, with nut 84 securing it within aperture 85. Gasket 80 is clipped to plate 82 to provide a seal.

Figure 4:
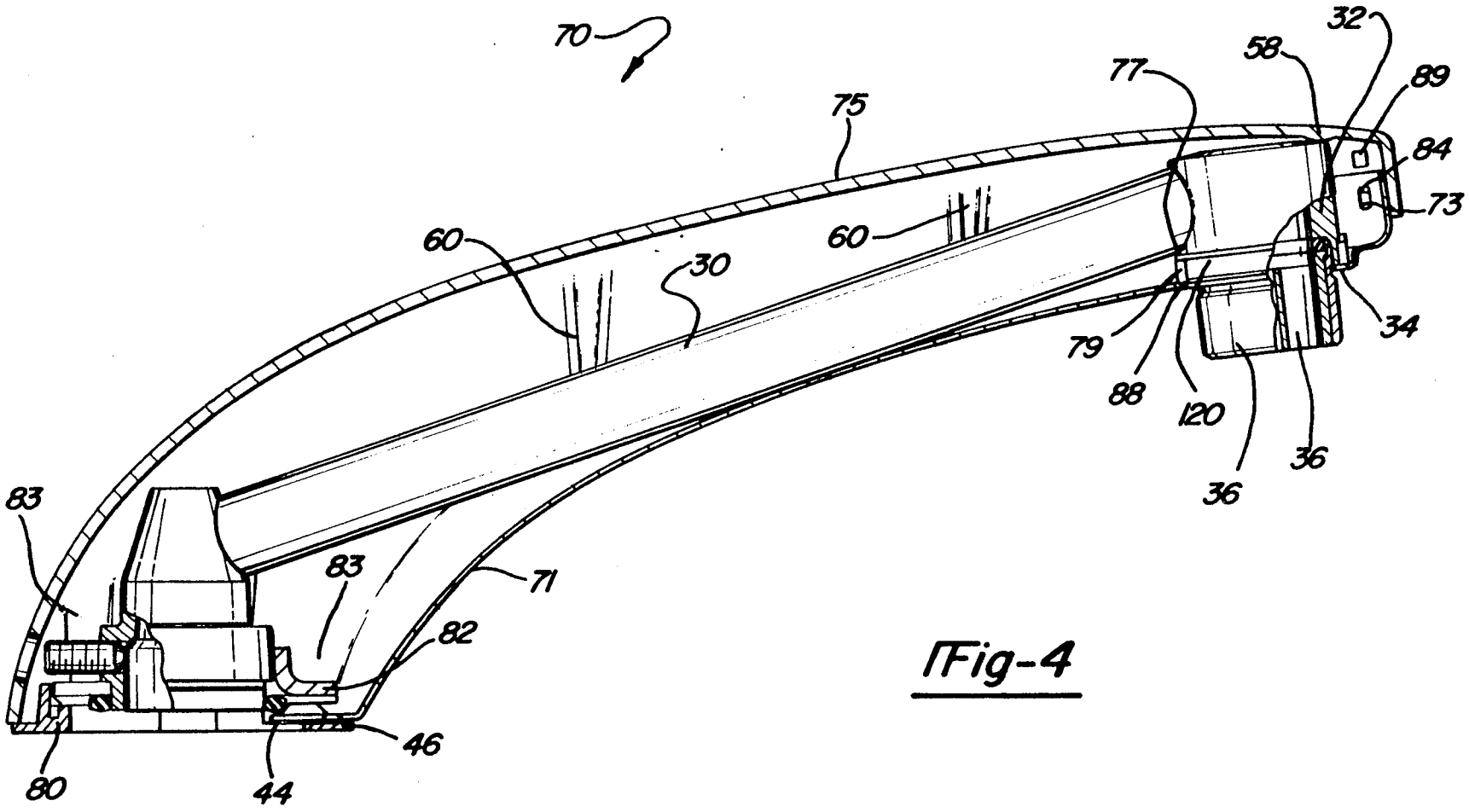
FIG. 4 is a cross-sectional view through the second embodiment shown in FIG. 3.

FIG. 4 is a cross-sectional view of fabricated spout 70. The screws not shown, extend through screw holes 44 formed in under cover 71 and into bosses 82 in upper cover 75. Notch 73 is received over tab 84 formed on an internal forward surface of upper cover 75 and beneath stop 89. It should be understood that a mating notch and tab combination is spaced on an opposed lateral side of faucet 70. Further, a pair of ribs 60 rest on lip 72 to provide additional stability to fabricated spout 70.

Seal 79 is received on first portion 120, but extends for a greater distance than first portion 120 and abuts second portion 77. When under cover 71 is secured to upper cover 75, rib 58 forces outlet end portion 32 downwardly into outlet 34 and seal 79 is compressed between an internal surface 88 of under cover 71 and second portion 77. Should end effector 36 be removed, seal 79 would prevent any leakage flow from outlet end 32 into the interior of the housing of spout 70. Although end effector 36 is shown connected by threads to outlet end portion 32, it should be understood that other connecting means would come within the scope of this invention.

Figure 5:
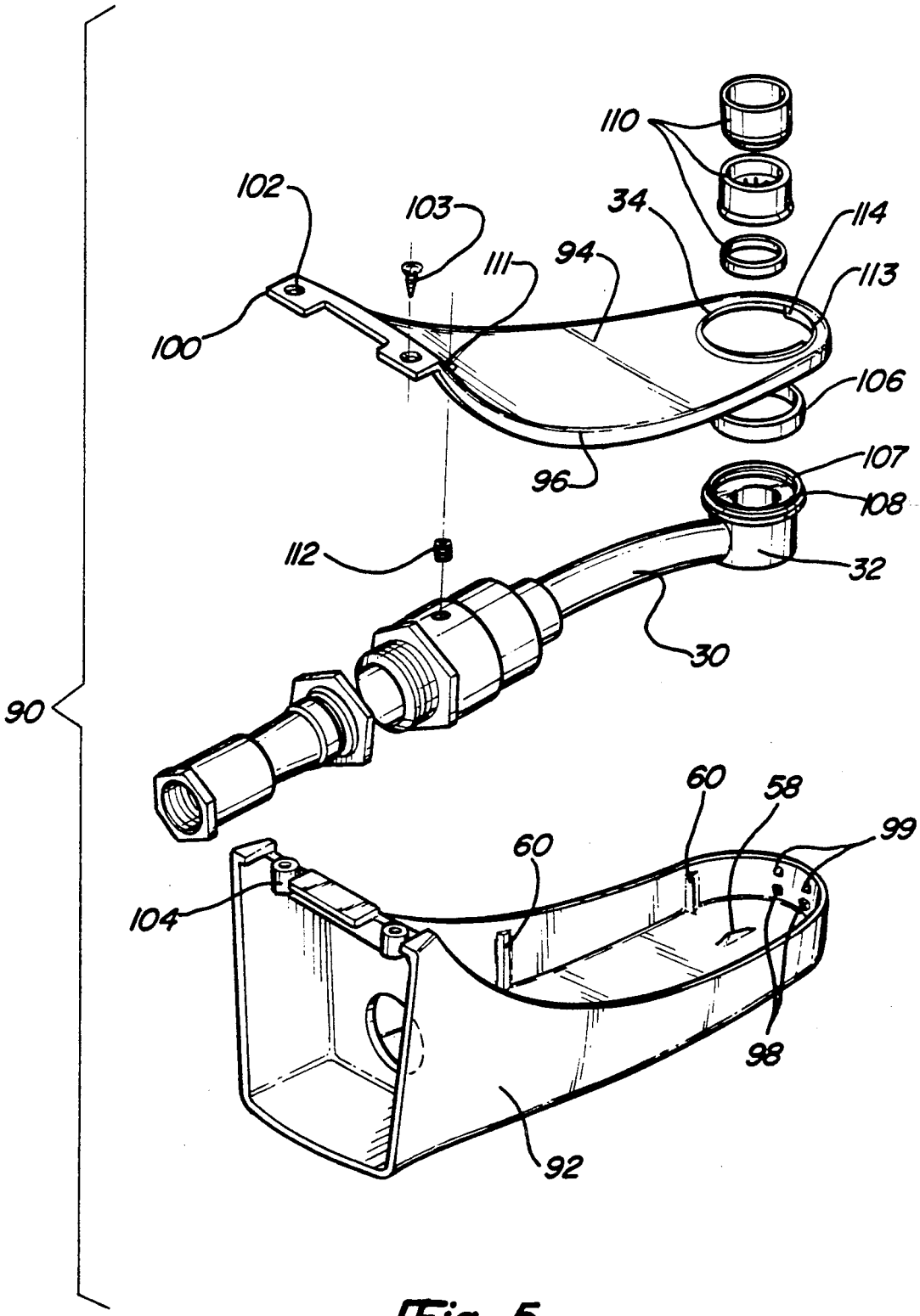
FIG. 5 is an exploded view of a third embodiment of the present invention.

A third embodiment fabricated spout 90 is illustrated in FIG. 5. Upper cover 92 is secured to under cover 94 which has a lip 96 received within an internal wall of upper cover 92. Tabs 99 and stops 98 are formed at positions spaced about a longitudinal axis of upper cover 92 and receive notches 114 formed in flange 113 at a forward end of under cover 94. Fluid line 30 is also received between upper cover 92 and under cover 94. Screws 103 extend through screw holes 102 in base 100 at a rear portion of under cover 94 and into bosses 104 formed in upper cover 92.

Seal 106 is received on first portion 107 at a bottom end of outlet end portion 32. Second portion 108 is of a greater diameter than first portion 107 and provides a stop for seal 106. End effector 110 is connected to internal threads in outlet end portion 32. Rib 58 forces fluid line 30, and in particular outlet end portion 32, into under cover 94 which compresses ring 106 to ensure an adequate seal.

An opening 111 formed in under cover 94 provides access to a set screw 112 which secures fluid line 30 to a fluid supply within the plumbing of the structure the faucet is connected to. Although this does create an irregularity in the bottom surface of under cover 94, it is necessary to properly secure the spout to the structure. The goals of this invention are still achieved with this embodiment since the number of screw holes formed in under cover 94 are reduced over the prior art spouts.

Figure 6:
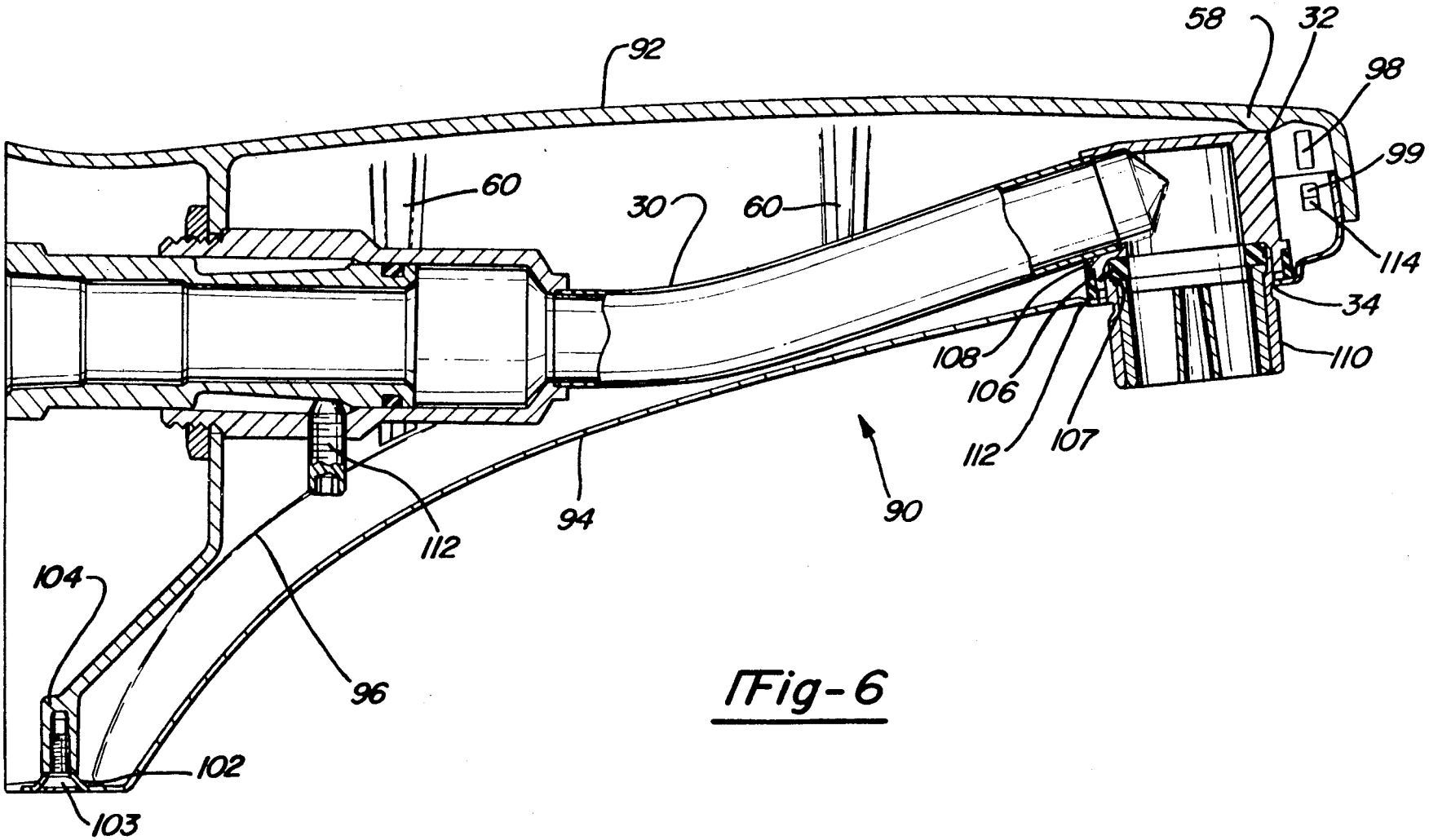
FIG. 6 is a cross-sectional view through the third embodiment illustrated in FIG. 5.

FIG. 6 is a cross-sectional view through faucet 90 illustrated in FIG. 5. Screws 103 extend through screw holes 102 and are received in bosses 104 as described above. Two ribs 60 rest on lip 96 and rib 58 forces outlet end 32 downwardly into an outlet 34 formed in under cover 94. Outlet end portion 32 is biased downwardly and compresses seal 106 received on first portion 107 of outlet end portion 32 between second portion 108 and an internal surface 112 of under cover 94. Thus, should end effector 110 be removed there would still be an adequate seal preventing water from leaking from the outlet into the body of the housing.

Notch 114 is shown received over tab 99 and beneath stop 98 to provide a connection between under cover 94 and upper cover 92 at a forward end. A mating connection is formed on an opposed lateral side of faucet 90.

Preferred embodiment of the present invention have been disclosed, however, a worker of ordinary skill in the art would recognize that certain modifications would come within the scope of this invention. For that reason, the following claims should be studied in order to determine the true scope and contact of this invention.

We claim:

1. A faucet spout comprising:

a housing formed of an under cover and an upper cover, means for securing said under cover to said upper cover, said under cover having an outlet opening;

a fluid line having an inlet and an outlet, said outlet being at an outlet end portion of said fluid line, said outlet end portion being aligned with said outlet opening, said outlet end portion having an inner peripheral surface with means to mount an end effector and an outer peripheral surface receiving a resilient sealing ring to provide a seal between said outlet end portion and an inner surface of said under cover; and said outlet end portion outer peripheral surface including first portion of a first outer diameter and a second portion upstream of said first portion of a second diameter greater than said first diameter, said second portion providing a stop for said seal ring and compressing said seal ring against said inner surface of said under cover when said under cover is secured to said upper cover by said means for securing, independently of the presence of an end effector.

2. A faucet spout as recited in claim 1, wherein said under cover having a lip received laterally within said upper cover, a notch formed in said lip at a forward position adjacent said outlet opening, and a tab formed on said upper cover and extending inwardly from an inner surface, said tab received in said notch to secure said lip to said upper cover.

3. A faucet spout as recited in claim 1, wherein securing members secure said under cover to said upper cover near said inlet.

4. A faucet spout as recited in claim 3, wherein said securing members are hidden by mounting means for said spout when said spout is mounted.

5. A faucet spout as recited in claim 4, wherein said securing members are screws.

6. A faucet spout as recited in claim 1, wherein said seal is rectangular in cross-section.

7. A faucet spout as recited in claim 6, wherein said means to mount an end effector include said outlet end portion being threaded at said inner peripheral surface.

8. A faucet spout as recited in claim 7, wherein said upper cover having a member within an inner periphery forcing said outlet end downwardly into said outlet port in said under cover.

* * * * *